US010909839B1

(12) United States Patent
Kursar

(10) Patent No.: US 10,909,839 B1
(45) Date of Patent: Feb. 2, 2021

(54) SYSTEM AND METHOD FOR OPTIMIZING RESCUE EFFORTS

(71) Applicant: Toyota Connected North America, Inc., Plano, TX (US)

(72) Inventor: Brian M. Kursar, Fairview, TX (US)

(73) Assignee: Toyota Connected North America, Inc., Plano, TX (US)

( * ) Notice: Subject to any disclaimer, the term of this patent is extended or adjusted under 35 U.S.C. 154(b) by 0 days.

(21) Appl. No.: 16/579,097

(22) Filed: Sep. 23, 2019

(51) Int. Cl.
*G08B 27/00* (2006.01)
*G08B 25/10* (2006.01)

(52) U.S. Cl.
CPC ..... *G08B 27/001* (2013.01); *G08B 25/10* (2013.01)

(58) Field of Classification Search
CPC ..... G08B 27/001; G08B 25/10
USPC ..... 340/539.18
See application file for complete search history.

(56) References Cited

U.S. PATENT DOCUMENTS

| | | | | |
|---|---|---|---|---|
| 6,556,981 | B2 | 4/2003 | Pedersen et al. | |
| 8,391,563 | B2 | 3/2013 | Georgis et al. | |
| 8,653,963 | B2 * | 2/2014 | Vallaire | G08B 27/008 340/539.1 |
| 8,682,034 | B2 | 3/2014 | Garoutte | |
| 9,135,808 | B2 * | 9/2015 | Johnson | G08B 25/009 |
| 9,232,040 | B2 * | 1/2016 | Barash | G16H 40/20 |
| 9,572,002 | B2 * | 2/2017 | South | H04W 4/90 |
| 9,633,318 | B2 | 4/2017 | Plante | |
| 9,792,500 | B2 | 10/2017 | Pennypacker et al. | |
| 10,178,353 | B2 | 1/2019 | Shishalov et al. | |
| 2013/0321149 | A1 | 12/2013 | Ben-Shmuel et al. | |
| 2018/0276983 | A1 | 9/2018 | Tani et al. | |

FOREIGN PATENT DOCUMENTS

| | | | |
|---|---|---|---|
| DE | 102016101149 | A1 | 7/2017 |
| KR | 20140127574 | A | 11/2014 |
| WO | 2006011804 | A1 | 2/2006 |

OTHER PUBLICATIONS

Allison et al., "Airborne Optical and Thermal Remote Sensing for Wildlife Detection and Monitoring," Sensors, 16(8): 1310, pp. 1-36 (2016).

* cited by examiner

*Primary Examiner* — John A Tweel, Jr.
(74) *Attorney, Agent, or Firm* — Christopher G. Darrow; Darrow Mustafa PC

(57) ABSTRACT

A system for optimizing rescue efforts includes one or more processors, a network access device and a memory device. The network access device and the memory device are in communication with the one or more processors. The memory device includes an event detection module, a transmission module, and a reception module. The event detection module has instructions that cause the one or more processor to determine a location of an emergency event. The transmission module causes the one or more processors to transmit the location via the network access device to one or more detection systems that are within a detection range of the emergency event, wherein the one or more detection systems are one or more vehicles. The reception module causes the one or more processor to obtaining information regarding the emergency event via the one or more sensors that are within the detection range of the emergency event.

20 Claims, 6 Drawing Sheets

SYSTEM AND METHOD FOR OPTIMIZING RESCUE EFFORTS

TECHNICAL FIELD

The subject matter described herein relates, in general, to a system and method for optimizing rescue efforts in response to an emergency event.

BACKGROUND

The background description provided is to present the context of the disclosure generally. Work of the inventor, to the extent it may be described in this background section, and aspects of the description that may not otherwise qualify as prior art at the time of filing, are neither expressly nor impliedly admitted as prior art against the present technology.

When an emergency event occurs, such as an earthquake, fire, flood, insurrection, and the like, response services may be dispatched to the location of the emergency event to prevent further destruction of property or harm to individuals. In order to assign appropriate response services to the emergency event, the dispatcher may need information regarding the emergency event, including location, type of event, and potential for destruction to property or harm to individuals.

SUMMARY

This section generally summarizes the disclosure and is not a comprehensive explanation of its full scope or all its features.

In one embodiment, a method for optimizing rescue efforts includes the steps of determining a location of an emergency event, transmitting the location to one or more detection systems having one or more sensors that are within a detection range of the emergency event, and obtaining information regarding the emergency event via the one or more sensors of the one or more detection systems that are within the detection range of the emergency event. The one or more detection systems may be one or more vehicles.

In another embodiment, a system for optimizing rescue efforts includes one or more processors, a network access device and a memory device. The network access device and the memory device are in communication with the one or more processors. The memory device includes an event detection module, a transmission module, and a reception module. The event detection module has instructions that cause the one or more processor to determine a location of an emergency event. The transmission module causes the one or more processors to transmit the location via the network access device to one or more detection systems that are within a detection range of the emergency event, wherein the one or more detection systems are one or more vehicles. The reception module causes the one or more processor to obtain information regarding the emergency event via the one or more sensors of the one or more detection systems that are within the detection range of the emergency event.

In yet another embodiment, a non-transitory computer-readable medium for optimizing rescue efforts includes instructions that when executed by one or more processors cause the one or more processors to determine a location of an emergency event, transmit the location to one or more detection systems having one or more sensors that are within a detection range of the emergency event, and obtain information regarding the emergency event via the one or more sensors of the one or more detection systems from the one or more detection systems that are within the detection range of the emergency event. The one or more detection systems may be one or more vehicles.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

A system and method for optimizing rescue efforts utilizes information collected from sensors mounted on one or more vehicles. When an emergency event occurs, the system can send a request out to the one or more vehicles located near the emergency event to provide information from the sensors mounted to the one or more vehicles. This information could include image-related information, such as video or still images of the environment in which the one or more vehicles are operating in. The information received by the system allows the system to determine the threat level of the emergency event. The threat level could include information regarding potential destruction to property and potential harm to individuals. Based on the threat level, the system can then dispatch appropriate response services to respond to the emergency event. By being able to utilize sensor information from one or more vehicles located near the emergency event, the system can have better information regarding the emergency event and therefore provide appropriate response services.

Figure 1:
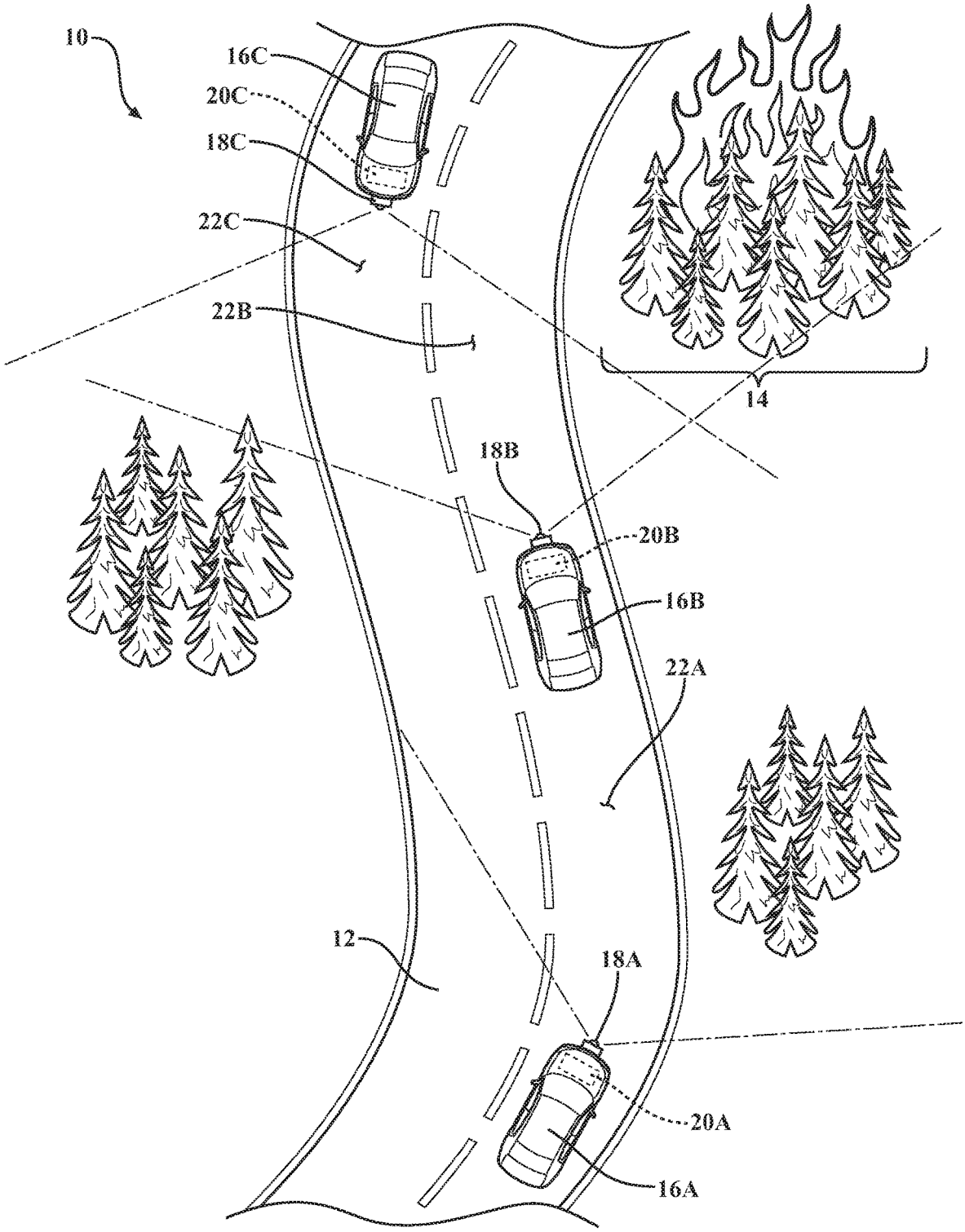
FIG. 1 illustrates an example of an emergency event and multiple detection systems that detect and provide information regarding the emergency event.

Referring to FIG. 1, an example 10 of a situation that utilizes a system for optimizing rescue efforts is shown. The example 10 illustrates a roadway 12 that allows for the travel of vehicles, such as vehicles 16A, 16B, and/or 16C. As this is just an example, it should be understood that any number of different vehicles may be utilized. Further, the vehicles 16A, 16B, and/or 16C may be any one of several different types of vehicles capable of transporting persons or items from one location to another. In the example shown in FIG. 1, the vehicles 16A, 16B, and 16C are in the form of an automobile. However, the vehicles 16A, 16B, and/or 16C may take any one of several different forms, such as a truck, heavy-duty truck, tractor-trailer, tractor, mining vehicle, military vehicle, and the like. In addition, the vehicles 16A, 16B, and/or 16C may not be limited to ground-based vehicles but could also include aircraft and seagoing vessels as well. The vehicles 16A, 16B, and/or 16C may be autonomous, semi-autonomous or manually operated vehicles according to one or more levels of automation such as the levels defined by the Society of Automotive Engineers (SAE) (e.g., levels 0-5).

The vehicles 16A, 16B, and/or 16C may be equipped with one or more sensor systems 18A, 18B, and/or 18C, respectively. As will be explained in greater detail later in this disclosure, the sensor systems 18A, 18B, and/or 18C may include any one of a number of different sensor systems, such as one or more cameras, LiDAR sensors, temperature sensors, air quality sensors, carbon dioxide/monoxide sensors, and the like. In this example, the sensors systems 18A, 18B, and 18C are cameras each having fields of view 22A, 22B, and 22C, respectively.

The example 10 includes an emergency event 14. Here, the emergency event 14 is a forest fire. It should be understood that the emergency event could be any type of event that may need a response from police, firefighters, medical personnel, military personnel, and the like. As such, the emergency event could include events caused by natural disasters, weather, and human-related events or combinations thereof. As an example, emergency events could include earthquakes, fires, floods, hurricanes, tornados, volcanic eruptions, civil insurrections, criminal activity, wars, and the like.

Currently, some systems rely on individuals to contact a dispatch system, such as a 911 system commonly utilized in the United States. From there, the dispatch system would collect information from the individual and dispatch a response. However, information from individuals can be unreliable, as it can be antiquated, secondhand information, or be false, exaggerated, or understated.

The system for optimizing rescue efforts requests information from one or more electronic systems 20A, 20B, and/or 20C of the vehicles 16A, 16B, and/or 16C, respectively. The electronic systems 20A, 20B, and/or 20C may be connected to the sensors systems 18A, 18B, and/or 18C, respectively. The electronic systems 20A, 20B, and/or 20C may then provide the system for optimizing rescue efforts information from the sensors systems 18A, 18B, and/or 18C. From there, the system for optimizing rescue efforts can then utilize the information from the sensors systems 18A, 18B, and/or 18C so as to dispatch the appropriate response services. In this example, the fields of view 22A, 22B, and 22C may provide different perspectives of the emergency event 14. As such, the system for optimizing rescue efforts could utilize this information from different perspectives to determine the appropriate response services that should be dispatched.

For example, as will be explained in greater detail later in this disclosure, information from the sensors systems 18A, 18B, and/or 18C could include information regarding the potential destruction of property and/or potential loss of life. Based on these factors, a threat factor can be determined, and appropriate response services can be dispatched. In one example, if it is determined that there is a significant potential for loss of life caused by the emergency event 14, the system for optimizing rescue efforts could prioritize the emergency event 14 as a high priority and dispatch more response services to the location of the emergency event 14. On the other hand, if it is determined that there is no potential for loss of life and only a potential for damaged property, the system for optimizing rescue efforts could downgrade the priority and either delay in dispatching response services or dispatch response services that are not occupied with higher priority emergency events.

Figure 2:
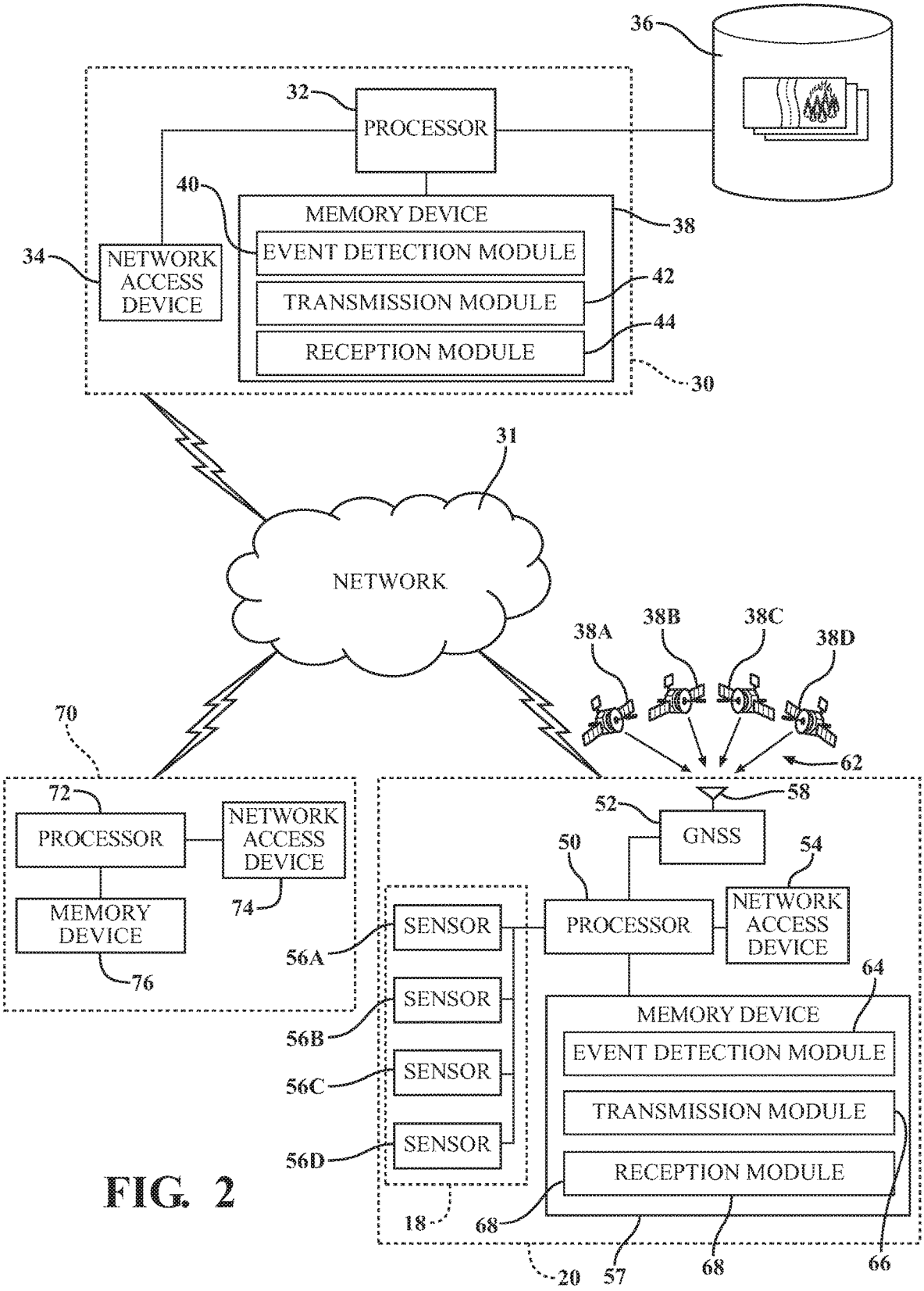
FIG. 2 illustrates a block diagram of a system for optimizing rescue efforts.

Referring to FIG. 2, a more detailed illustration of a system 30 for optimizing rescue efforts, an electronic system 20 for a vehicle, such as vehicles 16A, 16B, and/or 16C, and a dispatch system 70 is shown. With regards to the system 30 for optimizing rescue efforts, the system 30 may include one or more processors 32, a network access device 34, and a memory device 38. The network access device 34 and the memory device 38 may be in communication with the one or more processors 32.

The network access device 34 may be an electronic device, such as a circuit, that connects the one or more processors 32 to a network 31, such as the Internet. The network access device 34 may include any equipment required to make a connection to a wide area network from a local area network. As such, the network access device 34 acts as a conduit that allows for the communication of the one or more processors 32 to communicate with several different devices, such as the electronic system 20 for a vehicle and/or the dispatch system 70.

The memory device 38 may be any type of memory capable of storing information that can be utilized by the one or more processors 32. As such, the memory device 38 may be a solid-state memory device, magnetic memory device, optical memory device, and the like. In this example, the memory device 38 is separate from the one or more processors 32, but it should be understood that the memory device 38 may be incorporated within any of the one or more processors 32, as opposed to being a separate device.

The memory device 38 may be capable of storing one or more modules that when executed by the one or more processors 32 cause the one or more processors 32 to perform any one of several different methods disclosed in this disclosure. In this example, the memory device 38 includes an event detection module 40, a transmission module 42, and a reception module 44.

The event detection module 40 includes instructions that when executed by the one or more processors 32 causes the one or more processors 32 to determine the location of an emergency event. Several different methodologies may be employed that allow the event detection module 40 to determine the location of an emergency event, such as the emergency event 14 of FIG. 1. For example, the event detection module 40 may cause the one or more processors 32 to be able to receive information regarding the specific or general location of an emergency event. Information regarding the location of an emergency event may have originated from several different sources, such as the electronic system 20 of a vehicle and/or the dispatch system 70.

As to the electronic system 20 of the vehicle, the electronic system 20 of the vehicle could provide information to the one or more processors 32. The event detection module 40 could include instructions that are able to monitor information from the electronic system 20 of one or more vehicles. This information could include information from one or more sensors that are in communication with the electronic system 20. As to the dispatch system 70, the dispatch system 70 could receive information from a variety of different sources, including individuals or other entities contacting the dispatch system 70. Furthermore, information could be provided electronically by third parties that monitor emergency events to the one or more processors 32 regarding the location of any emergency events. For example, sensors that can detect earthquakes or fires could provide information either directly or indirectly to the one or more processors 32 and the event detection module 40 could use this information to determine the location of the emergency event.

Once the system 30 for optimizing rescue efforts has determined the location of the emergency event, the transmission module 42 causes the one or more processors 32 to transmit the location of the emergency event to one or more detection systems that have one or more sensors that are within a detection range of the emergency event, which may be vehicles such as vehicles 16A, 16B, and/or 16C of FIG. 1. The reception module 44 causes the one or more processors 32 to obtain information regarding the emergency event from one or more sensors of the one or more detection systems that are within the detection range of the emergency event.

For example, with regard to the example 10 shown in FIG. 1, the vehicles 16A, 16B, and 16C each have sensor systems 18A, 18B, and 18C that have fields of view 22A, 22B, and 22C, respectively. The fields of view 22A, 22B, and 22C of the sensor systems 18A, 18B, and 18C, respectively, are within a range capable of detecting information regarding the emergency event 14. As stated before, the sensor systems 18A, 18B, and 18C may be cameras that are capable of obtaining visual information of the emergency event 14 and can, therefore, relay this information to the one or more processors 32 of the system 30.

The transmission module 42 may also configure the one or more processors 32 to dispatch one or more responders to the location of the emergency event. In this example, the one or more processors 32 may communicate with the dispatch system 70 via the network 31. From there, the dispatch system 70 will then dispatch response services. Furthermore, the one or more processors 32 may communicate threat factor information to the dispatch system 70 and/or utilize threat factor information to determine and request the appropriate response services to be dispatched by the dispatch system 70.

For example, the threat factor could be broken up into different levels, wherein some levels do not necessarily require an immediate response by responders. Some levels may require a response by responders but may not be a priority. Further still, there may be some levels of the threat factor that require an immediate and overwhelming response by responders. In one example, the threat factor may include a property threat level and a loss of life threat level. With regards to a property threat level, the property threat level indicates that only property will be destroyed or has been destroyed by the emergency event. With regards to the loss of life threat level, this threat level may indicate the potential or actual loss of life caused by the emergency event. In this situation, a loss of life threat level would receive a higher priority than the property threat level. As such, the system 30 for optimizing rescue efforts and/or the dispatch system 70 could utilize the threat factor to optimally respond to the emergency event.

Furthermore, in one embodiment, the system 30 includes a data store 36. The data store 36 is, in one embodiment, an electronic data structure such as a database that is stored in the memory device 38 or another memory and that is configured with routines that can be executed by the one or more processors 32 for analyzing stored data, providing stored data, organizing stored data, and so on. Thus, in one embodiment, the data store 36 stores data used by the modules 40, 42, and/or 44 in executing various functions.

The modules 40, 42, and/or 44 could be a component of the one or more processors 32 or one or more of the modules 40, 42, and/or 44 can be executed on and/or distributed among other processing systems to which the one or more processors 50 are operatively connected. For example, the electronic system 20 and/or the dispatch system 70 could also execute and/or be included in the distribution among other processing systems to which the one or more processors 32 are operatively connected.

With regards to the electronic system 20 of the vehicle, the electronic system 20 may include one or more processors 50, a global navigation satellite system ("GNSS") 52, a network access device 54, sensors 56A-56D, and a memory device 57. As stated previously, the electronic system 20 may be mounted within a vehicle, such as vehicles 16A, 16B, and/or 16C of FIG. 1.

The GNSS system 52 may be a satellite navigation system that provides autonomous geo-spatial positioning with global coverage. The GNSS system 52 may include anyone of several different GNSS systems, such as GPS, GLONASS, Galileo, Beidou or other regional systems. The GNSS system 52 may be connected to an antenna 58 that is capable of receiving one or more signals 62 from one or more satellites 38A-38D. Based on the one or more signals 62 from one or more satellites 38A-38D, the GNSS system 52 can determine the relative location of the vehicle to which the GNSS system is installed. This relative location may be in the form of a coordinate system that may indicate the latitude, longitude, and/or altitude of a vehicle that has the GNSS system 52 installed within. As such, the GNSS system 52 allows the one or more processors 50 to determine the relative location of the vehicle to which it is installed, and then relay this information to the system 30 for optimizing rescue efforts.

The network access device 54 allows the one or more processors 50 of the electronic system 20 to communicate with a network 31, such as the Internet. As such, the network access device 54 may be any one of several different components that allow the transmission of information to the network 31 and therefore to other electronic systems and subsystems connected to the network 31. These electronic systems and subsystems could include the system 30 for optimizing rescue efforts and/or the dispatch system 70.

The one or more sensors 56A-56D may also be in communication with the one or more processors 50. The sensors 56A-56D may be any one of several different sensors capable of sensing any one of several different variables experienced by the vehicle and may form a sensor system 18. For example, sensor 56A could be a camera system that allows the electronic system 20 of the vehicle to capture visual information that may be related to the emergency event. The sensor 56B could be an external temperature sensor that allows the electronic system 20 of the vehicle to measure the outside temperature near the vehicle. The sensor 56C could be an air quality sensor that could include determining carbon dioxide/monoxide levels, smoke levels, and/or other environmental pollutants or air particles. The sensor 56D could be a LiDAR sensor that is capable of capturing three-dimensional point cloud information that could include three-dimensional point cloud information of the emergency event. This information could then be provided to the system 30 and the event detection module 40 could then cause the one or more processors 32 to determine the presence of an emergency event and/or the threat factor of the emergency event.

While the different types of sensors 56A-56D have been described, it should be understood that the sensors 56A-56D described are merely examples in that any one of a number of different sensors could be utilized to determine any one of a number of different variables experienced by the vehicle. The information sensed by the sensors 56A-56D may be provided to the one or more processors 50 and then relayed to the system 30 and/or dispatch system 70.

The memory device 57 may be any type of memory capable of storing information that can be utilized by the one or more processors 50. As such, the memory device 57 may be a solid-state memory device, magnetic memory device, optical memory device, and the like. In this example, the memory device 57 is separate from the one or more processors 50, but it should be understood that the memory device 57 may be incorporated within any of the one or more processors 50, as opposed to being a separate device.

The memory device 57 may include any one of several different modules to configure the one or more processors 50 to perform any one of several different functions or methodologies disclosed in this disclosure. In this example, the memory device 57 also includes an event detection module 64, a transmission module 66, and a reception module 68. The event detection module 64, transmission module 66 and/or reception module 68 may be similar to the event detection module 40, transmission module 42, and/or reception module 44, respectively, of the system 30 for optimizing rescue efforts. As such, these modules will not be described again as the previous description is equally applicable here. Therefore, in one example, the electronic system 20 of the vehicle could perform some or all of the functions of the system 30.

Further, the modules 64, 66, and/or 68 could be a component of the one or more processors 50 or one or more of the modules 64, 66, and/or 68 can be executed on and/or distributed among other processing systems to which the one or more processors 50 are operatively connected. For example, the system 30 and/or the dispatch system 70 could also execute and/or be included in the distribution among other processing systems to which the one or more processors 50 are operatively connected.

The dispatch system 70 may be any type of dispatch system that allows for the dispatching of responders. In one example, the dispatch system 70 includes one or more processors 72 in communication with a network access device 74 and a memory device 76. The network access device 74 allows the one or more processors 72 of the dispatch system 70 to communicate with a network 31, such as the Internet. As such, the network access device 74 may be any one of several different components that allow the transmission of information to the network 31 and therefore to other electronic systems and subsystems connected to the network 31. These electronic systems and subsystems could include system 30 for optimizing rescue efforts and/or the electronic system 20 of a vehicle.

The memory device 76 may include any one of several different modules that cause the one or more processors 72 to dispatch responders. In one such example, the memory device 76 is capable of configuring the one or more processors 72 to receive information from a variety of different sources. These sources could include information provided by eyewitnesses, third-party information, information from emergency responders, information from sensors, such as the sensors 56A-56D that form part of the electronic system 20 of the vehicle, other sensor systems, and the like.

Based on the information received from these sources, the one or more processors 72 may then be able to communicate with responders and dispatch the appropriate responders to an emergency event. Furthermore, it should be understood that the memory device 76 may include other modules previously described such as the event detection module 40, the transmission module 42 and/or the reception module 44. By so doing, the dispatch system 70 may perform any of the methods performed by the system 30 for optimizing rescue efforts and or the electronic system 20 of the vehicle.

Figure 3A:
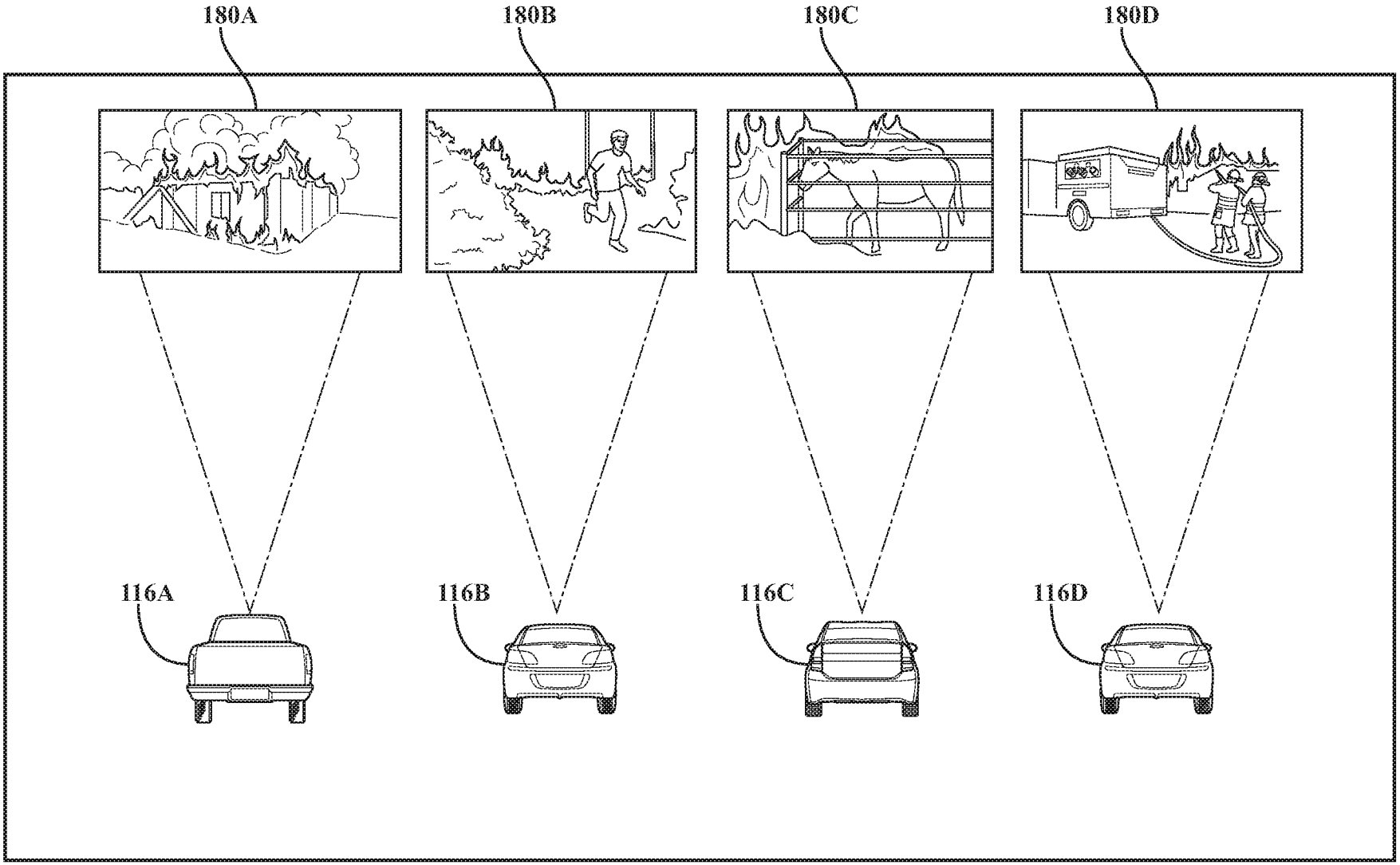
FIGS. 3A and 3B illustrate example images captured by one or more sensors of one or more detection systems.

Referring to FIG. 3A, an example of information captured by one or more sensors, such as sensors systems 18A, 18B, and/or 18C of FIG. 1 or sensors 56A-56D of FIG. 2 is shown. Here, vehicles 116A-116D each include camera-based sensors. However, it should be understood that any type of sensor may be utilized as previously described. The camera-based sensors of the vehicles 116A-116D can capture images 180A-180D of an emergency event. In this example, the emergency event is a fire. Image 180A illustrates damage to a structure. Image 180B illustrates potential harm to a person. Image 180C illustrates potential harm to an animal. Image 180D illustrates responders in the form of a fire truck and a firefighter that are responding to the emergency event.

In one example, the images 180A-180D may be transmitted to the one or more processors 32 of the system 30 for optimizing rescue efforts. Moreover, the event detection module 40 may configure the one or more processors 32 to determine that an emergency event has occurred. The transmission module 42 may then configure the processor 32 to communicate with the one or more vehicles 116A-116D to request that they transmit information that of the emergency event. In this case, the information is in the form of images 180A-180D which may be still images, recorded videos, or live videos.

Figure 3B:
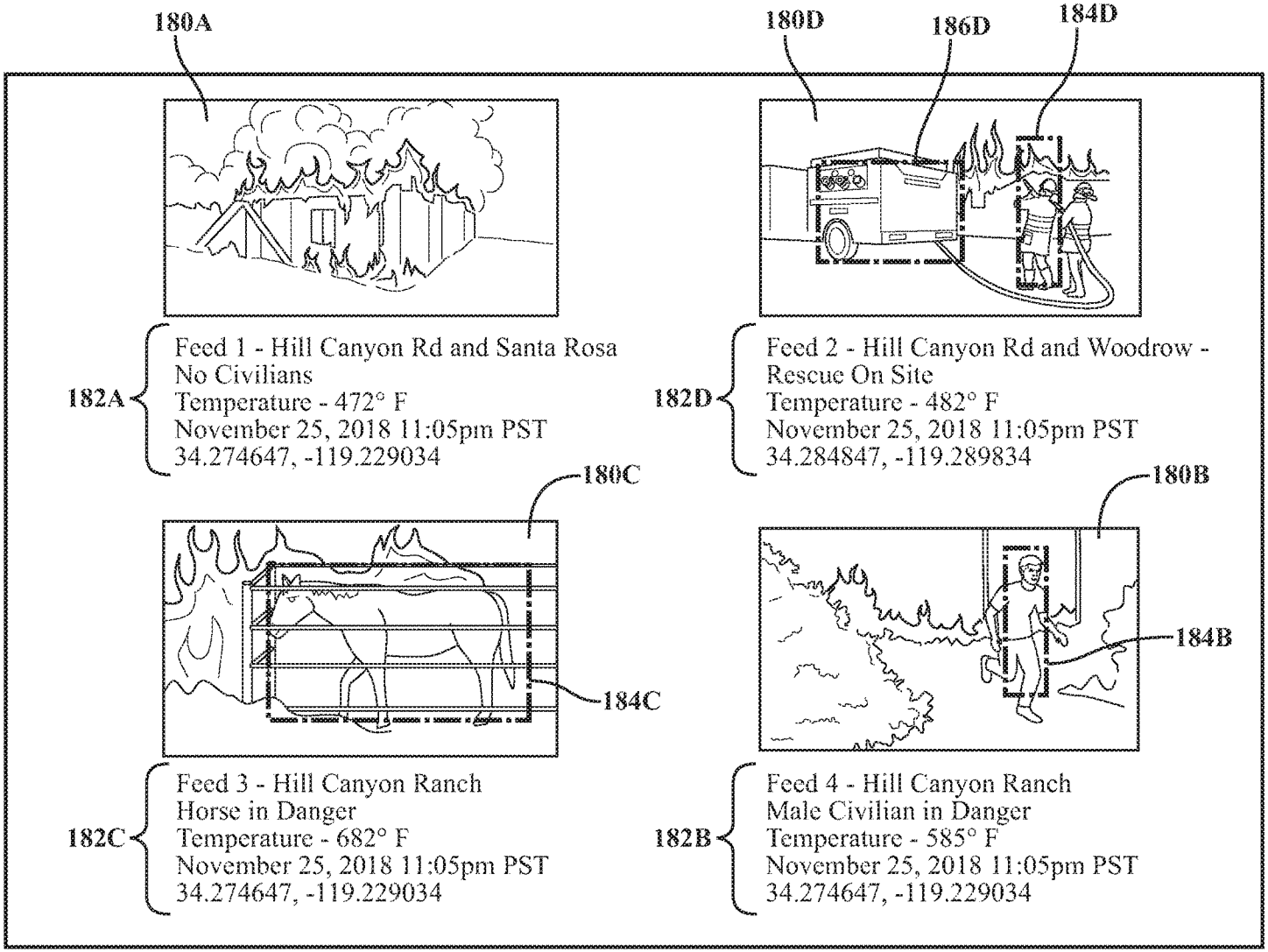

Referring to FIG. 3B, the event detection module 40 of FIG. 2 may cause the one or more processors 32 to analyze the information provided by the vehicles 116A-116D. Here, the information, as previously described, is in the form of images 180A-180D. The event detection module 40 may cause one or more processors 32 of the system 30 to determine a threat factor of the event. Here, the event detection module 40 causes the one or more processors 32 to determine that the image 180A indicates that the damage caused by the event relates to property and does not relate to persons or animals. Further, the one or more sensors of the vehicle 116A may also be able to provide other information, such as information 182A. This other information could include information regarding the temperature detected by the one or more sensors, the location of the vehicle, and the timestamp of any information collected by the one or more sensors of the vehicle 116A.

The image 180B captured by the vehicle 116B may be determined by the system 30 to contain a person as indicated in rectangle 184B. The information 182B may indicate that a person is in danger and may indicate the temperature of the location, the timestamp of when the image 180B was captured and the location of the vehicle 116B. From here, the event detection module 40 may configure the one or more processors 32 to determine that the threat factor includes a loss of life threat level and that responders should be dispatched to prevent the loss of life.

The image 180C captured by vehicle 116C may be sent to the system 30 and the event detection module 40 can configure the processor 32 to detect if any animals are in danger, as indicated in rectangle 184C. The detection of an animal as indicated in rectangle 184C may cause the event detection module 40 to increase the threat factor to be somewhere between a level regarding property loss and a level regarding the potential loss of life. In addition to this information, information 182C regarding the temperature, the timestamp in which the image 180C was captured and the location of the vehicle 116C may also be sent to the system 30.

The image 180D was captured by vehicle 116D of the event and may be sent to the system 30 and the event detection module 40 can configure the processor 32 to detect the presence of any responders and associated equipment, such as fire trucks, police cars, military equipment, and the like. Here, the image includes a responder 184D in the form of a firefighter and a response vehicle 186D in the form of a fire truck. In addition, information 182D may indicate that a rescue is underway, the temperature of the area, the timestamp in which the image 180D was captured and the location of the vehicle 116D.

It should be understood that the examples given in FIGS. 3A and 3B are merely examples and are directed towards emergency events that involve a fire. As such, different information could be collected by the vehicles 116A-116D that may be more appropriate based on the type of emergency event has occurred. For example, with regards to an emergency event that concerns flooding, information regarding the temperature of the location may be less valuable, but information regarding the weather may be more valuable.

Figure 4A:
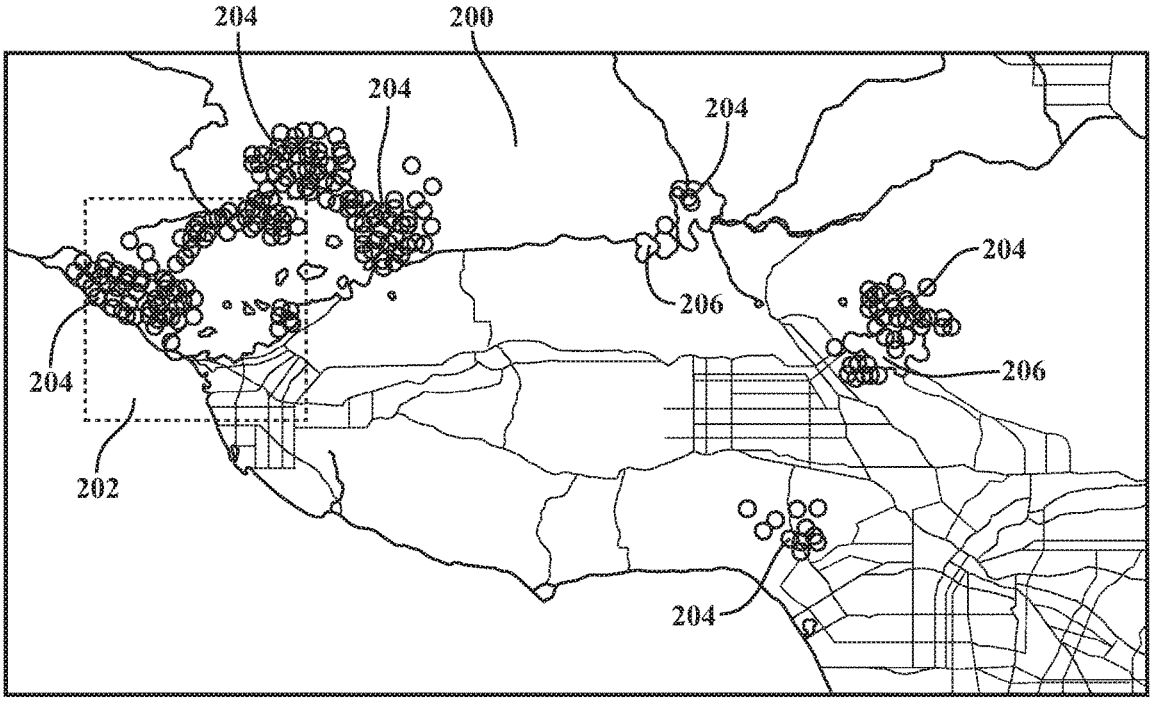
FIGS. 4A and 4B illustrate example images of maps generated by the system for optimizing rescue efforts.

The event detection module 40 may also be able to configure the one or more processors 32 to generate an electronic map that indicates the location of the emergency event and/or the location of any detection devices, which, as stated previously, may be one or more vehicles. For example, in FIG. 4A, an electronic map 200 is shown generated by the one or more processors 32. The electronic map 200 includes indicia 204 that indicates reports of emergency events and the location of the emergency events. The indicia 206 indicates the confirmed location of emergency events. Here, the electronic map 200 may allow one to zoom into an area 202.

Figure 4B:
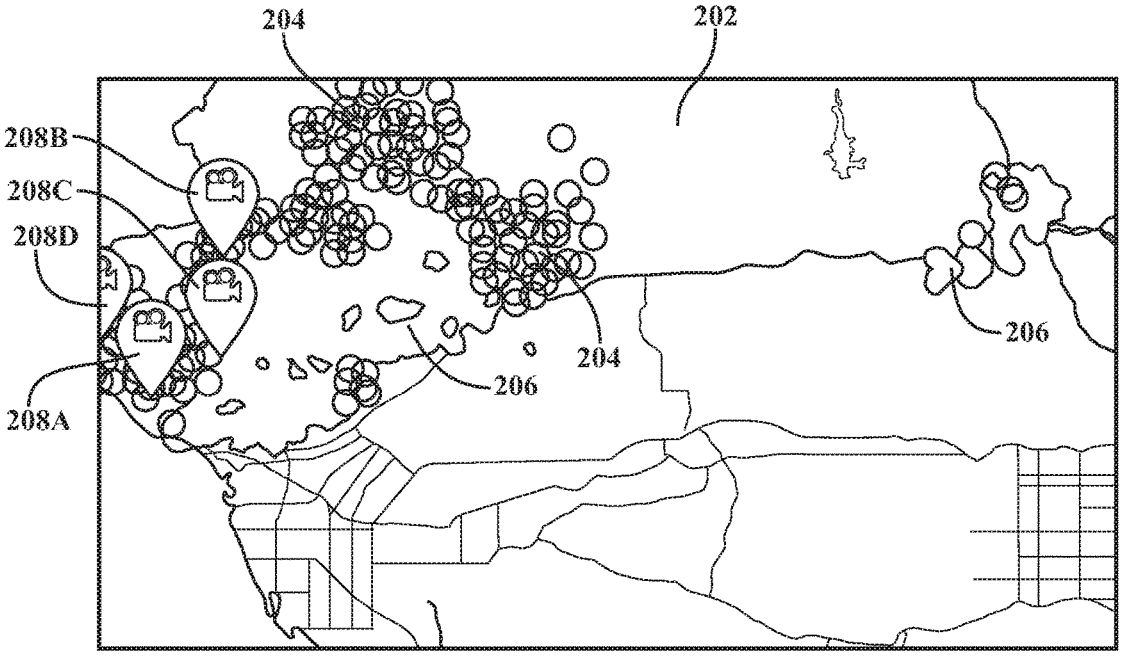

FIG. 4B illustrates the zoomed in area 202. Here, the zoomed in area 202 also shows the indicia 204 reports of an emergency event as well as the indicia 206 indicating the actual location of an emergency event. In addition, the zoomed in area 202 also displays the location of vehicles 208A-208D that are capable of transmitting sensor information from the vehicles 208A-208D to the system 30 for optimizing rescue efforts. Here, the zoomed in area 202 may allow one to select the vehicles 208A-208D. After selecting a vehicle, the system 30 may then be able to provide information from the vehicles 208A-208D which could include the information shown in FIGS. 3A and 3B, such as images from the camera sensors of the vehicles 208A-208D and other information such as temperature, location, and timestamp information.

Figure 5:
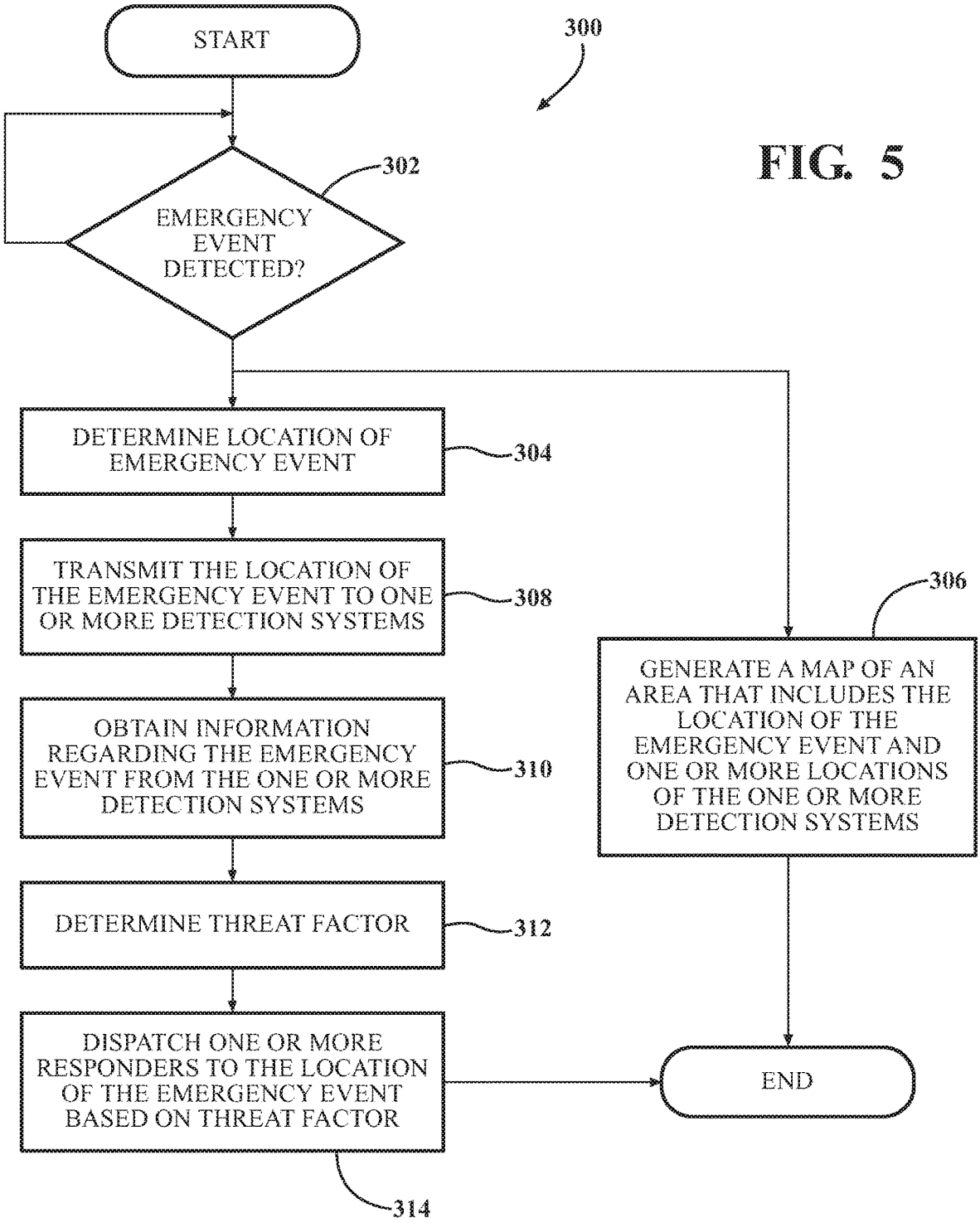
FIG. 5 illustrates a method for optimizing rescue efforts.

Referring to FIG. 5, a method 300 for optimizing rescue efforts is shown and will be discussed from the perspective of the system 30 for optimizing rescue efforts of FIG. 2. While method 300 is discussed in combination with the system 30 for optimizing rescue efforts, it should be appreciated that the method 300 is not limited to being implemented within the system 30 for optimizing rescue efforts but is instead one example of a system that may implement the method 300.

The method 300 begins at step 302. At step 302, the event detection module 40 causes the one or more processors 32 of the system 30 to determine if an emergency event has been detected. This determination may be made by any one of several different methodologies. For example, the event detection module 40 may cause the one or more processors 32 to be able to receive information regarding the specific or general location of an emergency event. Information regarding the location of an emergency event may have originated from several different sources, such as the electronic system 20 of a vehicle and/or the dispatch system 70. If no emergency event is detected, the method 300 may continue the monitor for events.

If an emergency event is detected, the method 300 proceeds to step 304, where a determination is made regarding the location of the emergency event. The event detection module 40 may configure the one or more processors 32 of the system 30 to determine the location of the emergency event based on the received information. This received information could come from a variety of different sources, such as the dispatch system 70, the electronic system 20 of a vehicle, or other sources, such as third-party sources, eyewitness accounts, other types of sensors, and the like.

Additionally or alternatively, the method 300 may also include step 306. In step 306, the event detection module 40 configures the one or more processors 32 to generate a map of an area that includes the location of the emergency event and/or one or more locations of one or more detection systems. Examples of this electronic map were shown in previously described in FIGS. 4A and 4B.

In step 308, the transmission module 42 configures the one or more processors 32 of the system 30 to transmit the location of the emergency event to one or more detection systems, which may be one or more vehicles. In response, the detection systems that have sensors that can collect information regarding the emergency event will then provide this information to the system 30. As such, the reception module 44 configures the one or more processors 32 to obtain information regarding the emergency event from the one or more detection systems as indicated in step 310.

In step 312, the event detection module 40 configures the one or more processors 32 of the system 30 to determine a threat factor. As stated previously, the threat factor could include a variety of different levels that indicate different potential losses. For example, the threat factor could include a loss of life threat level and a loss of property threat level. The loss of life threat level is an indication that the emergency event has caused or may potentially cause loss of life. The loss of property threat level may indicate that the emergency event has caused or may potentially cause damage or destruction of property.

In step 314, the transmission module 42 configures the one or more processors 32 of the system 30 to dispatch one or more responders to the location of the emergency event based on the threat factor. Here, the one or more processors 32 considers the threat factor to determine when and/or if responders should be sent to a location of an emergency event. For example, if there is no potential for loss of life and little potential for property damage, the one or more processors 32 may determine that responders do not need to be dispatched or should only be dispatched if there are no higher priority events. Conversely, if it is determined that there could be a significant loss of life, the one or more processors 32 may determine that all available responders should respond to the location of the emergency event or even repurpose responders that are responding to a lower priority event to respond to this higher priority event.

It should be appreciated that any of the systems described in this specification can be configured in various arrangements with separate integrated circuits and/or chips. The circuits are connected via connection paths to provide for communicating signals between the separate circuits. Of course, while separate integrated circuits are discussed, in various embodiments, the circuits may be integrated into a common integrated circuit board. Additionally, the integrated circuits may be combined into fewer integrated circuits or divided into more integrated circuits.

In another embodiment, the described methods and/or their equivalents may be implemented with computer-executable instructions. Thus, in one embodiment, a non-transitory computer-readable medium is configured with stored computer executable instructions that when executed by a machine (e.g., processor, computer, and so on) cause the machine (and/or associated components) to perform the method.

While for purposes of simplicity of explanation, the illustrated methodologies in the figures are shown and described as a series of blocks, it is to be appreciated that the methodologies are not limited by the order of the blocks, as some blocks can occur in different orders and/or concurrently with other blocks from that shown and described. Moreover, less than all the illustrated blocks may be used to implement an example methodology. Blocks may be combined or separated into multiple components. Furthermore, additional and/or alternative methodologies can employ additional blocks that are not illustrated.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations.

The flowcharts and block diagrams in the figures illustrate the architecture, functionality, and operation of possible implementations of systems, methods, and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or another apparatus adapted for carrying out the methods described herein is suited. A combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer readable program code embodied, e.g., stored, thereon. Any combination of one or more computer-readable media may be utilized. The computer-readable medium may be a computer readable signal medium or a computer-readable storage medium. The phrase "computer-readable storage medium" means a non-transitory storage medium. A computer-readable medium may take forms, including, but not limited to, non-volatile media, and volatile media. Non-volatile media may include, for example, optical disks, magnetic disks, and so on. Volatile media may include, for example, semiconductor memories, dynamic memory, and so on. Examples of such a computer-readable medium may include, but are not limited to, a floppy disk, a flexible disk, a hard disk, a magnetic tape, other magnetic medium, an ASIC, a graphics processing unit (GPU), a CD, other optical medium, a RAM, a ROM, a memory chip or card, a memory stick, and other media from which a computer, a processor or other electronic device can read. In the context of this document, a computer-readable storage medium may be any tangible medium that can contain or store a program for use by or in connection with an instruction execution system, apparatus, or device.

The following includes definitions of selected terms employed herein. The definitions include various examples and/or forms of components that fall within the scope of a term, and that may be used for various implementations. The examples are not intended to be limiting. Both singular and plural forms of terms may be within the definitions.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

"Module," as used herein, includes a computer or electrical hardware component(s), firmware, a non-transitory computer-readable medium that stores instructions, and/or combinations of these components configured to perform a function(s) or an action(s), and/or to cause a function or action from another logic, method, and/or system. Module may include a microprocessor controlled by an algorithm, a discrete logic (e.g., ASIC), an analog circuit, a digital circuit, a programmed logic device, a memory device including instructions that when executed perform an algorithm, and so on. A module, in one or more embodiments, may include one or more CMOS gates, combinations of gates, or other circuit components. Where multiple modules are described, one or more embodiments may include incorporating the multiple modules into one physical module component. Similarly, where a single module is described, one or more embodiments distribute the single module between multiple physical components.

Additionally, module, as used herein, includes routines, programs, objects, components, data structures, and so on that perform tasks or implement data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an application-specific integrated circuit (ASIC), a hardware component of a system on a chip (SoC), as a programmable logic array (PLA), as a graphics processing unit (GPU), or as another suitable hardware component that is embedded with a defined configuration set (e.g., instructions) for performing the disclosed functions.

In one or more arrangements, one or more of the modules described herein can include artificial or computational intelligence elements, e.g., neural network, fuzzy logic, or other machine learning algorithms. Further, in one or more arrangements, one or more of the modules can be distributed among a plurality of the modules described herein. In one or more arrangements, two or more of the modules described herein can be combined into a single module.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A method for optimizing rescue efforts, the method comprising the steps of:

determining a location of an emergency event provided by a first entity;

transmitting the location and an information request to one or more detection systems having one or more sensors that are within a detection range of the emergency event, wherein the one or more detection systems are one or more vehicles; and in response to the information request, obtaining information regarding the emergency event from the one or more sensors of the one or more detection systems of entities different from the first entity that are within the detection range of the emergency event.

2. The method of claim 1, further comprising the step of dispatching one or more responders to the location of the emergency event based on a threat factor generated by information from the one or more sensors of the one or more detection systems.

3. The method of claim 2, wherein the threat factor further comprises:

a property threat level indicating probable destruction to property by the emergency event; and a loss of life threat level indicating probable loss of life by the emergency event.

4. The method of claim 1, wherein the one or more sensors of the detection systems are one or more cameras.

5. The method of claim 1, further comprising the step of updating the location of the emergency event based on the information received from the one or more detection systems.

6. The method of claim 1, wherein the information regarding the emergency event includes at least one of: temperature information, visual information, audible information, and air quality information.

7. The method of claim 1, further comprising the step of generating a map of an area that includes the location of the emergency event and one or more locations of the one or more detection systems.

8. A system for optimizing rescue efforts, the system comprising:

one or more processors;

a network access device in communication with the one or more processors;

a memory device in communication with the one or more processors, the memory device comprising an event detection module having instructions that cause the one or more processor to determine a location of an emergency event provided by a first entity;

a memory device in communication with the one or more processors, the memory device comprising a transmission module having instructions that cause the one or more processor to transmit the location and an information request via the network access device to one or more detection systems of entities different from the first entity having one or more sensors that are within a detection range of the emergency event, wherein the one or more detection systems are one or more vehicles; and the memory device comprising a reception module having instructions that cause the one or more processors to, in response to the information request, obtain information regarding the emergency event via the one or more sensors of the one or more detection systems that are within the detection range of the emergency event.

9. The system of claim 8, wherein the transmission module includes instructions that when executed by the one or more processors cause the one or more processors to dispatch one or more responders to the location of the emergency event based on a threat factor generated by information from the one or more sensors of the one or more detection systems.

10. The system of claim 9, wherein the threat factor further comprises:

a property threat level indicating probable destruction to property by the emergency event; and a loss of life threat level indicating probable loss of life by the emergency event.

11. The system of claim 8, wherein the one or more sensors of the detection systems are one or more cameras.

12. The system of claim 8, wherein the event detection module includes instructions that when executed by the one or more processors cause the one or more processors to update the location of the emergency event based on the information received from the one or more detection systems.

13. The system of claim 8, wherein the information regarding the emergency event includes at least one of: temperature information, visual information, audible information, and air quality information.

14. The system of claim 8, wherein the event detection module includes instructions that when executed by the one or more processors cause the one or more processors to generate a map of an area that includes the location of the emergency event and one or more locations of the one or more detection systems.

15. A non-transitory computer-readable medium for optimizing rescue efforts, the non-transitory computer-readable medium comprising instructions that when executed by one or more processors cause the one or more processors to:

determine a location of an emergency event provided by a first entity;

transmit the location and an information request to one or more detection systems of entities different from the first entity having one or more sensors that are within a detection range of the emergency event, wherein the one or more detection systems are one or more vehicles; and in response to the information request, obtain information regarding the emergency event via the one or more sensors of the one or more detection systems that are within the detection range of the emergency event.

16. The non-transitory computer-readable medium of claim 15, further comprising instructions that when executed by one or more processors cause the one or more processors to dispatch one or more responders to the location of the emergency event based on a threat factor generated by information from the one or more sensors of the one or more detection systems.

17. The non-transitory computer-readable medium of claim 16, wherein the threat factor further comprises:

a property threat level indicating probable destruction to property by the emergency event; and a loss of life threat level indicating probable loss of life by the emergency event.

18. The non-transitory computer-readable medium of claim 15, further comprising instructions that when executed by one or more processors cause the one or more processors to update the location of the emergency event based on the information received from the one or more detection systems.

19. The non-transitory computer-readable medium of claim 15, wherein the information regarding the emergency event includes at least one of: temperature information, visual information, audible information, and air quality information.

20. The non-transitory computer-readable medium of claim 15, further comprising instructions that when executed by one or more processors cause the one or more processors to generate a map of an areas that includes the location of the emergency event and one or more locations of the one or more detection systems.

* * * * *